US010027019B2

(12) United States Patent
Han et al.

(10) Patent No.: US 10,027,019 B2
(45) Date of Patent: Jul. 17, 2018

(54) ANTENNA USING CONDUCTOR AND ELECTRONIC DEVICE THEREFOR

(71) Applicants: HongJuan Han, Shenzhen (CN); YueHua Yue, Shenzhen (CN)

(72) Inventors: HongJuan Han, Shenzhen (CN); YueHua Yue, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 37 days.

(21) Appl. No.: 15/417,129

(22) Filed: Jan. 26, 2017

(65) Prior Publication Data

US 2017/0346162 A1 Nov. 30, 2017

(30) Foreign Application Priority Data

May 27, 2016 (CN) ..... 2016 2 0505748 U

(51) Int. Cl.
*H01Q 1/24* (2006.01)
*H01Q 1/40* (2006.01)

(52) U.S. Cl.
CPC ..... *H01Q 1/243* (2013.01); *H01Q 1/40* (2013.01)

(58) Field of Classification Search
CPC ..... H01Q 1/243; H01Q 1/40
See application file for complete search history.

(56) References Cited

U.S. PATENT DOCUMENTS

2014/0333488 A1* 11/2014 Wang ..... H01Q 1/243 343/702
2017/0033436 A1* 2/2017 Yan ..... H01Q 1/243

* cited by examiner

*Primary Examiner* — Robert Karacsony
(74) *Attorney, Agent, or Firm* — Na Xu; IPro, PLLC

(57) ABSTRACT

The present disclosure provides an antenna device, including a housing having accommodating space and an LDS antenna accommodated in the hosing, the housing includes a metal shell, a metal cover and a metal ring which cooperate and are spaced with each other, wherein inner walls of the metal shell, the metal cover and the metal ring are respectively provided with an adhesive coated layer, the adhesive coated layer includes an adhesive coated layer body, a groove provided at a side of the adhesive coated layer body far away from the metal cover, and a modified layer assembled in the groove, the LDS antenna is laser etched on the modified layer and is coupled with the metal cover. The antenna device of the present disclosure avoids frequency offset caused by gap size difference due to assembling errors between coupled antennas, so that the coupled antennas show better performance and consistency.

9 Claims, 7 Drawing Sheets

ANTENNA USING CONDUCTOR AND ELECTRONIC DEVICE THEREFOR

TECHNICAL FIELD

The present disclosure relates to the field of mobile communication technologies and, in particular, to an antenna device and a mobile terminal.

BACKGROUND

With the development of mobile communication technologies, electronic products such as cellphone, PAD, laptop etc. have become a necessity in people's life, and such electronic products are provided with an antenna system so that they become electronic communication products having communication functions.

A laser direct structuring (Laser Direct Structuring, LDS) antenna in the related art is generally installed into a speaker of a cellphone. However, the size of the gap between the speaker and a metal back cover which serves as an antenna radiator of a cellphone is difficult to be controlled within 0.1 mm. Moreover, coupled antennas are sensitive to the gap size between antennas, tiny difference in the gap size may result in dozens or hundreds MHz of frequency offset, which may lead to significant frequency offset difference between antennas, thereby restricting the application of coupled antenna in the cellphone.

Therefore, there is a necessity to provide a new antenna device so as to solve the above problem.

DESCRIPTION OF EMBODIMENTS

The present disclosure will be further illustrated with reference to the accompanying drawings and the embodiments.

Figure 1:
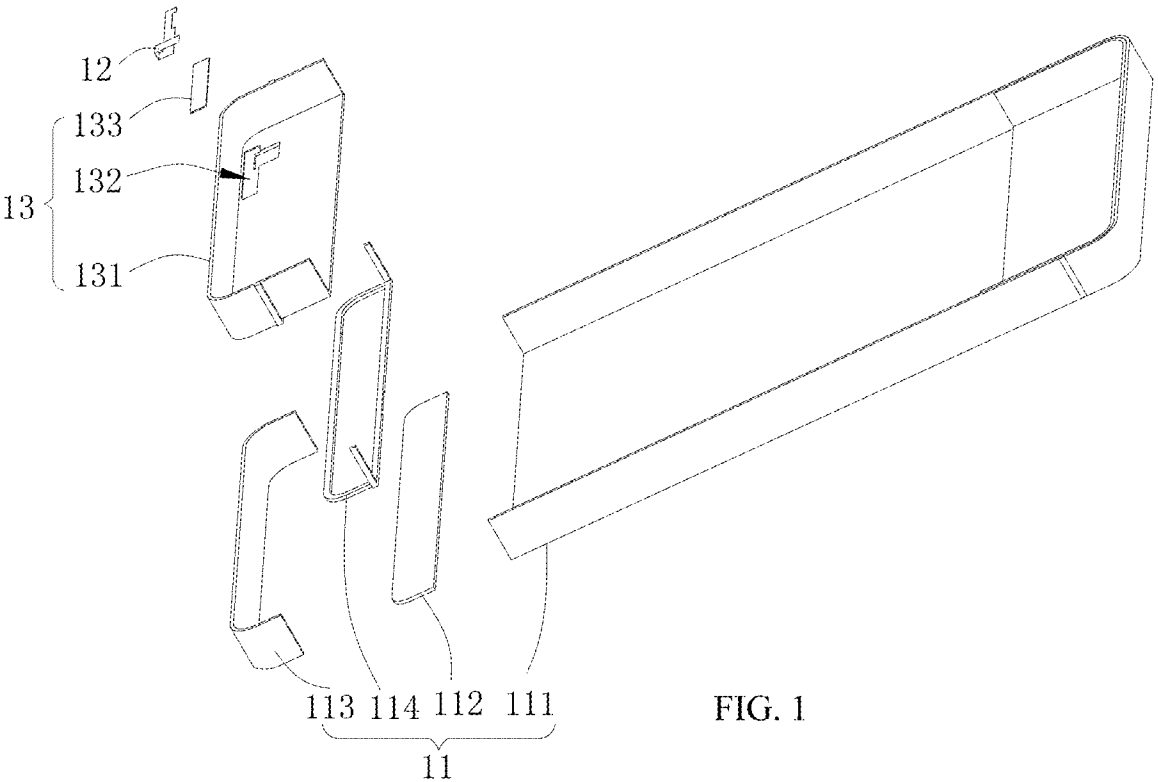
FIG. 1 is a perspective exploded view of an antenna device in accordance with the present disclosure.

Please refer to FIG. 1, which is a perspective exploded view of an antenna device in accordance with the present disclosure. The antenna device 1 includes a housing 11 having accommodating space, an LDS antenna 12 accommodated in the housing 11 and an adhesive coated layer 13 provided on an inner wall of the housing 11.

The housing 11 includes a metal shell 111, a metal cover 112, a metal ring 113 and a connecting piece 114. The metal shell 111, the metal cover 112 and the metal ring 113 cooperate and are spaced with each other, and are connected via the connecting piece 114. The LDS antenna 12, the metal ring 113 and the metal cover 112 are the radiator of the antenna device 1, the LDS antenna 12, the metal ring 113 and the metal cover 112 are coupled to form an antenna. The LDS antenna 12 is installed on the adhesive coated layer 13 of the metal cover 112, and is coupled with the metal cover 112 and the metal ring 113. Moreover, the adhesive coated layer 13 is inject molded and combined on inner walls of the metal shell 111, the metal cover 112 and the metal ring 113, so that the gap size between the LDS antenna 12 and the metal cover 112 which serves as a radiator, the control precision is good, which can avoid frequency offset due to gap size caused by assembling error between antennas, so as to meet the requirements of the antenna on bandwidth and the antenna shows better performance, meanwhile broadening the application range of antennas device 1. In the present embodiment, the connecting piece 114 is made of PBT material, and is integrated with the adhesive coated layer 13 as a whole, so that the metal shell 111, the metal cover 112 and the metal ring 113 are separated and isolated with each other.

The adhesive coated layer 13 is provided on inner walls of the metal housing 11, the metal cover 112 and the metal ring 113. In the present embodiment, the adhesive coated layer 13 is formed by inject molding process on inner walls of the metal housing 11, the metal cover 112 and the metal ring 113, and the adhesive coated layer 13 is combined with the inner walls of the metal housing 11, the metal cover 112 and the metal ring 113, and then the adhesive coated layer 13 is laser etched and chemically plated.

Figure 2:
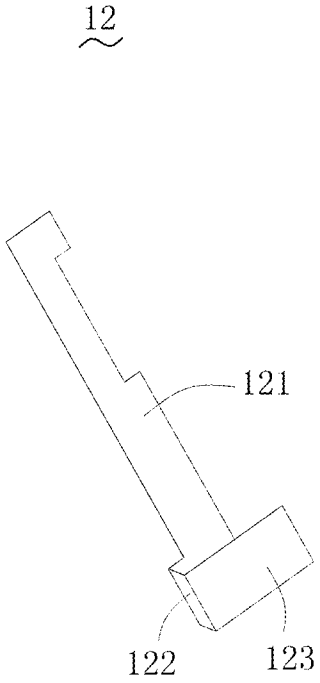
FIG. 2 is a structural schematic view of an LDS antenna of the antenna device shown in FIG. 1.

Please refer to FIG. 2, which is a structural schematic view of an LDS antenna of the antenna device shown in FIG. 1. The LDS antenna 12 includes a main portion 121, a first extending portion 122 extending from the main portion 121 and a second extending portion 123 extending from the first extending portion 122. The main portion 121 is coupled with the metal cover 112, the first extending portion 122 is coupled with the metal ring 113. In the present embodiment, the first extending portion 122 is perpendicularly connected with the main portion 121, the second extending portion 123 is arranged to be perpendicular to the first extending portion 122 and parallel to the main portion 121. The LDS antenna 12 is coupled with the metal cover 112 and the metal ring 113 so as to form an antenna, configured to receive and transmit radio waves. The LDS antenna 12 is directly installed on the inner wall of the adhesive coated layer 13 of the metal cover 112, the gap size between the LDS antenna 12 and the metal cover 112 can be controlled with the minimum tolerance (±0.05 mm) of the acceptable thickness size of the adhesive coated layer 13, so that the coupled antennas show better performance and consistency. Meanwhile the LDS antenna 12 is coupled with the metal cover 112, so as to meet the requirements of the antenna on bandwidth, and the antenna performance is good.

Figure 3:
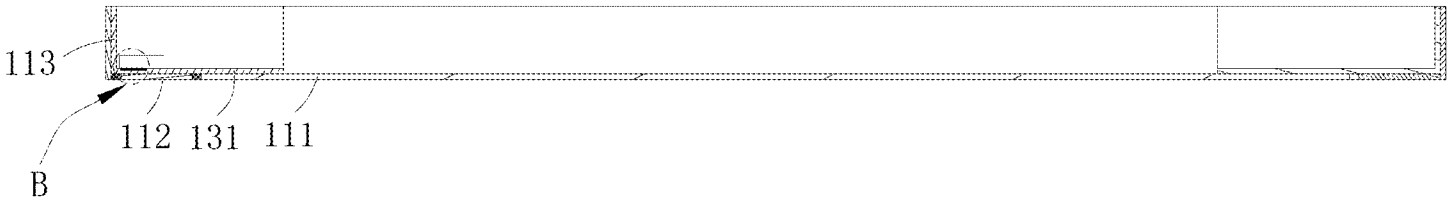
FIG. 3 is an sectional view of the antenna device shown in FIG. 1.
Figure 4:
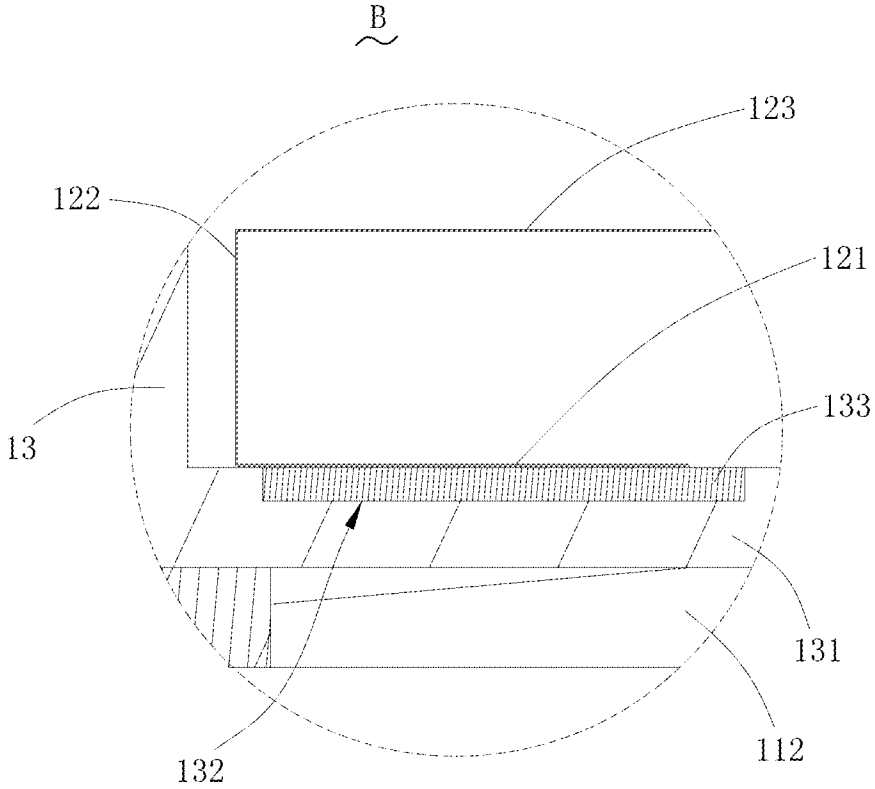
FIG. 4 is an enlarged view of portion B shown in FIG. 3.

Please refer to FIG. 3 and FIG. 4, FIG. 3 is a sectional view of the antenna device shown in FIG. 1; FIG. 4 is an enlarged view of portion B shown in FIG. 3. The adhesive coated layer 13 includes an adhesive coated layer body 131, a groove 132 provided on a side of the adhesive coated layer body 131 far away from the metal cover 112 and a modified layer 133 assembled in the groove. The LDS antenna 12 is laser etched on the modified region 133 and is coupled with the housing 11. In the present embodiment, the adhesive coated layer body 131 is integrated with the modified layer 133 as a whole. Firstly, inject molding the PBT material on the inner walls of the metal shell 111, the metal cover 112 and the metal ring 113 using a nano inject molding technique, so as to form the adhesive coated layer body 131, and reserve the groove 132 on a side of the adhesive coated layer body 131 far away from the metal cover 112; inject molding PC/ABS material in the groove 132 using nano inject molding technique; and finally laser etching, chemically plating the region corresponding to the groove 132, so as to form the modified layer 133. PC/ABS material is a thermo plastic formed by polymerizing polycarbonate (PC) and acrylonitrile butadiene styrene (ABS), since a metal material is doped, metallic compound will be separated from the PC/ABS material through laser etching, the exposed metal atoms will provide a seed layer for chemical plating in the following step, the chemical plating will form a metal layer in the laser activated region so as to form the modified layer 133, so that the antenna is more flexible which, in particular, significantly broadens the application range of the coupled antenna in antennas which are sensitive to the surrounding environment dimensions.

Figure 5:
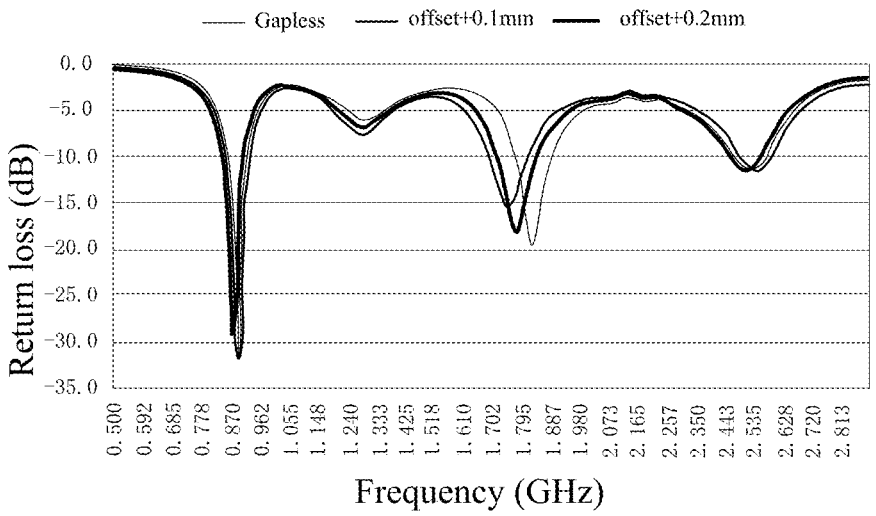
FIG. 5 is a view showing return loss of gap offset between an LDS antenna and an inner wall of an adhesive coated layer in an antenna device in accordance with the present disclosure.

Please refer to FIG. 5, which is a view showing return loss of gap offset between an LDS antenna and an inner wall of an adhesive coated layer in an antenna device in accordance with the present disclosure. "Original" means that the LDS antenna 12 is completely fitted with the inner wall of the adhesive coated layer 13 of the housing 11 without a gap; "+" means that the gap size between the LDS antenna 12 and the inner wall of the adhesive coated layer 13 of the housing 11 increases. From the figure, it can be seen that, size change of the gap between the LDS antenna 12 and the inner wall of the adhesive coated layer 13 of the housing 11 only influences frequency bands of 824-960 MHz and 1710-2170 MHz, in particular frequency band of 1710-2170 MHz. Please refer to Table 1-1.

TABLE 1-1

Influence of gap size between LDS antenna and the inner wall of adhesive coated layer

| Frequency | Gap size difference | Frequency offset |
|---|---|---|
| 1710-2170 HZ | +0.1 mm | +20 MHz |
| | +0.2 mm | +60 MHz |

Figure 6:
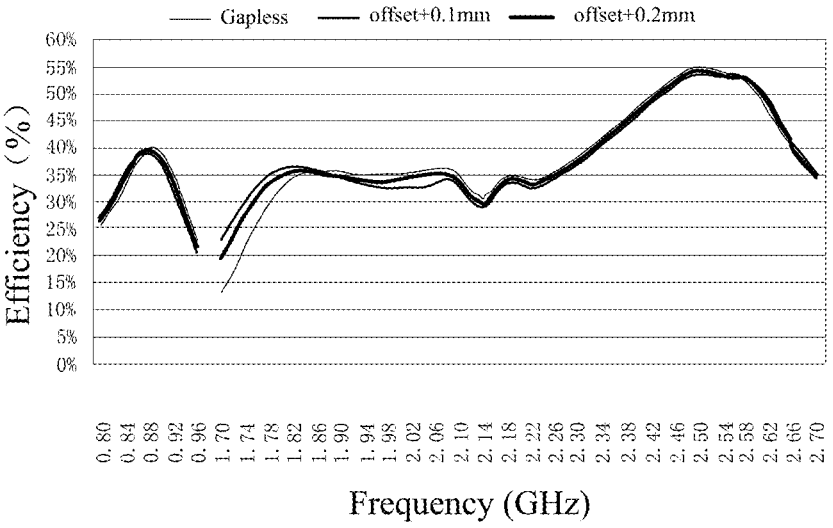
FIG. 6 is a view showing antenna efficiency of gap offset between an LDS antenna and an inner wall of an adhesive coated layer in an antenna device in accordance with the present disclosure.

Please refer to FIG. 6, which is a view showing antenna efficiency of gap offset between an LDS antenna and an inner wall of an adhesive coated layer in an antenna device in accordance with the present disclosure. Since the coupled antenna is sensitive to the gap size between two antennas, tiny difference in the gap size may result in dozens or hundreds MHz of frequency offset, which may lead to significant frequency offset difference between antennas, thereby restricting the application of coupled antenna in the cellphone. With reference to Table 1-2, for the above antenna, when the LDS antenna 12 is installed in the speaker box of the cellphone, the size of a gap between the speaker box and the metal back cover 112 is difficult to be controlled within 0.1 mm, which may result in large frequency offset difference among antennas (may exceed 100 MHz), and thus design risk exists.

TABLE 1-2

Size tolerance when antenna installed in speaker box and on inner wall of adhesive coated layer

| Process | Component | Tolerance dimension |
|---|---|---|
| LDS antenna installed | Tolerance of adhesive | ±0.05 mm |

TABLE 1-2-continued

Size tolerance when antenna installed in speaker box and on inner wall of adhesive coated layer

| Process | Component | Tolerance dimension |
|---|---|---|
| on speaker box | coated layer | |
| | Tolerance of speaker box | ±0.1 mm |
| | Assembling tolerance | ±0.15 mm |
| | Total tolerance | ±0.3 mm |
| LDS antenna installed on inner wall of adhesive coated layer | Tolerance of adhesive coated layer (total tolerance) | ±0.05 mm |

Figure 7:
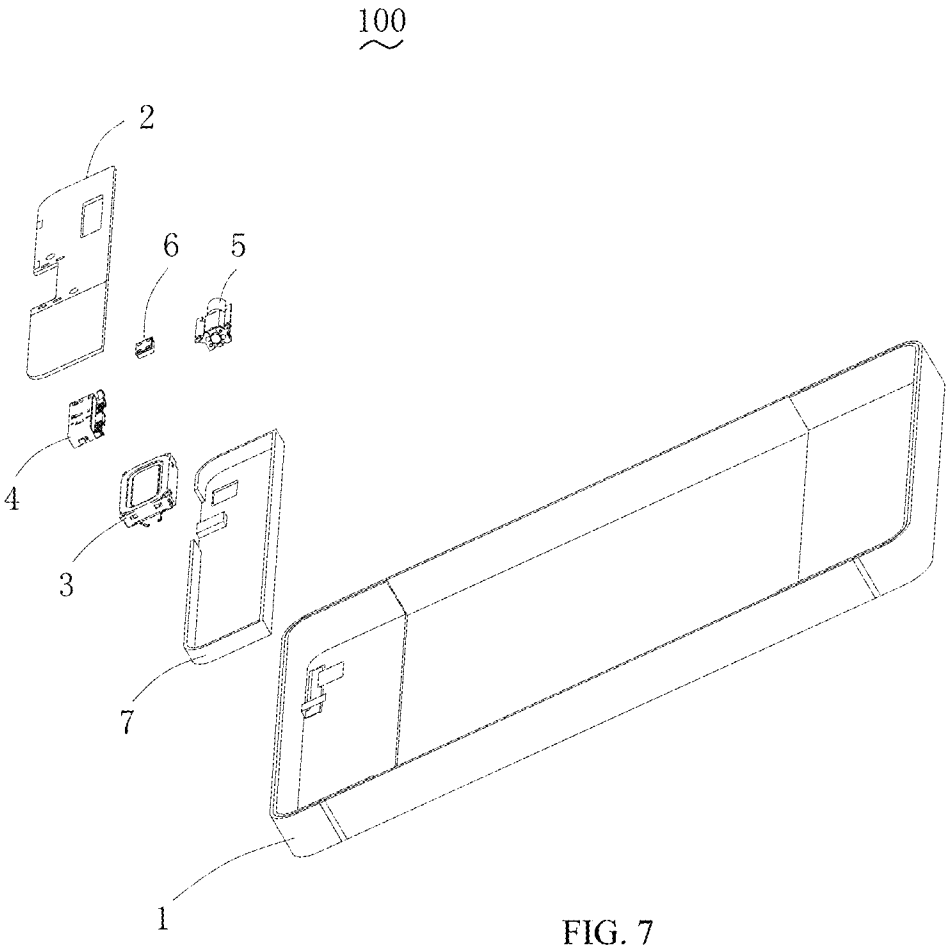
FIG. 7 is a perspective exploded view of a mobile terminal adopting the antenna device shown in FIG. 1 in accordance with the present disclosure.

Please refer to FIG. 7, which is a perspective exploded view of a mobile terminal adopting the antenna device shown in FIG. 1 in accordance with the present disclosure. A mobile terminal 100 includes an antenna device 1, a main board 2 accommodated in the housing 11 of the antenna device 1, a speaker 3, a USB module 4, a vibrating motor 5, a microphone 6 respectively fixed on the main board 2 and electrically connected with the main board 2, and a speaker box 7. The main board 2 is provided at a side of the adhesive coated layer 13 far away from the metal cover 112. The LDS antenna 12 is located between the speaker box 7 and the adhesive coated layer 13. The speaker box 7 has accommodating space, the speaker 3, the USB module 4, the vibrating motor 5 and the microphone 6 are accommodated in the speaker box 7, the speaker box 7 fixes the main board 2 and the components arranged on the main board 2 in the mobile terminal 100. In the present embodiment, the mobile terminal 100 can be cellphone, laptop and PC etc. It should be noted that, the mobile terminal 100 is not limited to the above components, and may include other components provided in the mobile terminal 100, which will not be listed herein.

The LDS antenna of the antenna device is laser etched on the modified layer of the adhesive coated layer and coupled with the metal cover, so that the gap size between the LDS antenna and the metal cover can be controlled with the minimum tolerance of the acceptable thickness size of the adhesive coated layer, thereby the coupled antennas show better performance and consistency. Meanwhile the LDS antenna is coupled with the metal cover, so as to meet the requirements of the antenna on bandwidth, and broaden the application range of coupled antennas in mobile terminal.

It should be noted that, the above are merely embodiments of the present disclosure, those skilled in the art can make improvements without departing from the inventive concept of the present disclosure, however, these improvements shall belong to the protection scope of the present disclosure.

What is claimed is:

1. An antenna device, comprising:

a housing having accommodating space; and a laser direct structuring (LDS) antenna accommodated in the hosing, the housing comprises a metal shell, a metal cover and a metal ring which cooperate and are spaced with each other, wherein inner walls of the metal shell, the metal cover and the metal ring are respectively provided with an adhesive coated layer, the adhesive coated layer comprises an adhesive coated layer body, a groove provided at a side of the adhesive coated layer body far away from the metal cover, and a modified layer assembled in the groove, the LDS antenna is laser etched on the modified layer and is coupled with the metal cover.

2. The antenna device as described in claim 1, wherein the adhesive coated layer is inject molded on the inner walls of the metal shell, the metal cover and the metal ring.

3. The antenna device as described in claim 1, wherein the adhesive coated layer body is integrated with the modified layer as a whole.

4. The antenna device as described in claim 3, wherein the adhesive coated layer body is made of polybutylene terephthalate (PBT) material, the modified layer is made of polymerizing polycarbonate acrylonitrile butadiene styrene (PC/ABS) material.

5. The antenna device as described in claim 1, wherein the LDS antenna comprises a main portion, a first extending portion extending from the main portion and a second extending portion extending from the first extending portion, the main portion is coupled with the metal cover, the first extending portion is coupled with the metal ring.

6. The antenna device as described in claim 5, wherein the first extending portion is perpendicularly connected with the main portion, the second extending portion is arranged to be perpendicular to the first extending portion and parallel to the main portion.

7. The antenna device as described in claim 1, wherein the housing further comprises a connecting piece, the metal shell, the metal ring and the metal cover are connected via the connecting piece.

8. The antenna device as described in claim 7, wherein the connecting piece is integrated with the adhesive coated layer as a whole.

9. A mobile terminal device, wherein the mobile terminal device adopts the antenna device as described in claim 1.

* * * * *